US006918741B2

(12) United States Patent
Gilbert et al.

(10) Patent No.: US 6,918,741 B2
(45) Date of Patent: Jul. 19, 2005

(54) MOLTEN METAL PUMP IMPELLER SYSTEM

(75) Inventors: Ronald Gilbert, Liberty Lake, WA (US); Mark Palmer, Spokane, WA (US)

(73) Assignee: Pyrotek, Inc., Spokane, WA (US)

( * ) Notice: Subject to any disclaimer, the term of this patent is extended or adjusted under 35 U.S.C. 154(b) by 0 days.

(21) Appl. No.: 10/298,159

(22) Filed: Nov. 15, 2002

(65) Prior Publication Data

US 2004/0096330 A1 May 20, 2004

(51) Int. Cl.[7] ..... F04D 7/06

(52) U.S. Cl. ..... 415/90; 415/206; 416/181; 416/182

(58) Field of Search ..... 415/200, 206, 415/90, 110, 112; 416/181, 182, 179, 185, 223 B

(56) References Cited

U.S. PATENT DOCUMENTS 6,464,458 B2 * 10/2002 Vild et al. ..... 415/200

* cited by examiner

*Primary Examiner*—Edward K. Look
*Assistant Examiner*—Dwayne J. White
(74) *Attorney, Agent, or Firm*—Wells St. John P.S.

(57) ABSTRACT

An impeller system for use in a molten metal pump, the impeller system including a generally cylindrical outer wall with outlets therein, an impeller lid mounted on the impeller walls, the impeller lid including a plurality of inlets, with the shaft being mounted directly into a base, which is mounted relative to the outer wall. The impeller system has an open interior defined by the outer wall, the lid and the base, and the impeller shaft mounts directly into the base without the need for a collar or attachment to the impeller lid.

3 Claims, 7 Drawing Sheets

MOLTEN METAL PUMP IMPELLER SYSTEM

CROSS REFERENCE TO RELATED APPLICATION

There are no related applications.

TECHNICAL FIELD

This invention pertains to a molten metal pump impeller system for use in pumping molten metal.

BACKGROUND OF THE INVENTION

This invention relates to molten metal pumps and more particularly to an impeller system suited for use in a molten metal pump. While references may be made herein to molten aluminum, this is only used by way of example and not to limit the invention to molten aluminum pumps, since the pump and impeller systems disclosed herein may be used for pumping other molten metals.

When molten metal is processed, it is often necessary to move molten metal within a particular vessel or container and from one location to another. Partially or wholly submersed pumps are generally used to accomplish this movement of molten metal.

In many applications, a rotatable impeller is located within a pumping chamber and utilized as part of the pumping system. The rotation of the impeller within the pumping chamber draws in molten metal and forces it out in a direction dictated by the geometry and outlet of the pumping chamber and molten metal pump.

Impeller systems are typically supported and mounted for rotation by a shaft connected to a drive motor which is located on a platform typically maintained above the surface level of the molten metal in the vessel or container.

Molten metal may be one of the more difficult environments in which to maintain a pump and impeller due to the heat and corrosive factors within the molten metal. The submerged components of these pumps are typically made of graphite, ceramics or similar materials due to the ability of these types of material compositions to withstand the heat and corrosive effects of the molten metal environment. Furthermore, in many applications there are large pieces of metal which are not melted and which may clog a molten metal pump if allowed to enter and then it gets trapped therein.

Once a pump is clogged or needs to be replaced or serviced, replacement is a time consuming exercise. First the pump must be removed from the molten metal, which generally causes down time of the metal furnace if that is the location of the pump. Then the pump along with the molten metal contained thereon must be allowed to sufficiently cool to allow it to be disassembled. Once the deteriorated components are sufficiently cool, the molten metal built up on the various pump surfaces must be sufficiently removed to allow disassembly and/or reuse of the pump components. Then the pump must be reassembled with the combination of old components or parts, along with the replacement parts. The down time of a molten metal pump may be as much as two to three days before it is operational again, which illustrates the importance of increasing the useful life of the pumps.

It may also be desirable in some embodiments of the invention to configure the impeller so that the interior cavity is more open with greater clearances, than for instance, impellers which include individual conduits or apertures through which the molten metal flows.

It is an object of this invention to provide a pump impeller system which is relatively efficient and relatively less prone to clogging by particles and other solid materials.

BRIEF DESCRIPTION OF THE DRAWINGS

Preferred embodiments of the invention are described below with reference to the following accompanying drawings.

FIG. 4 is an exploded elevation view of the impeller-system illustrated in FIG. 2;

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Figure 1:
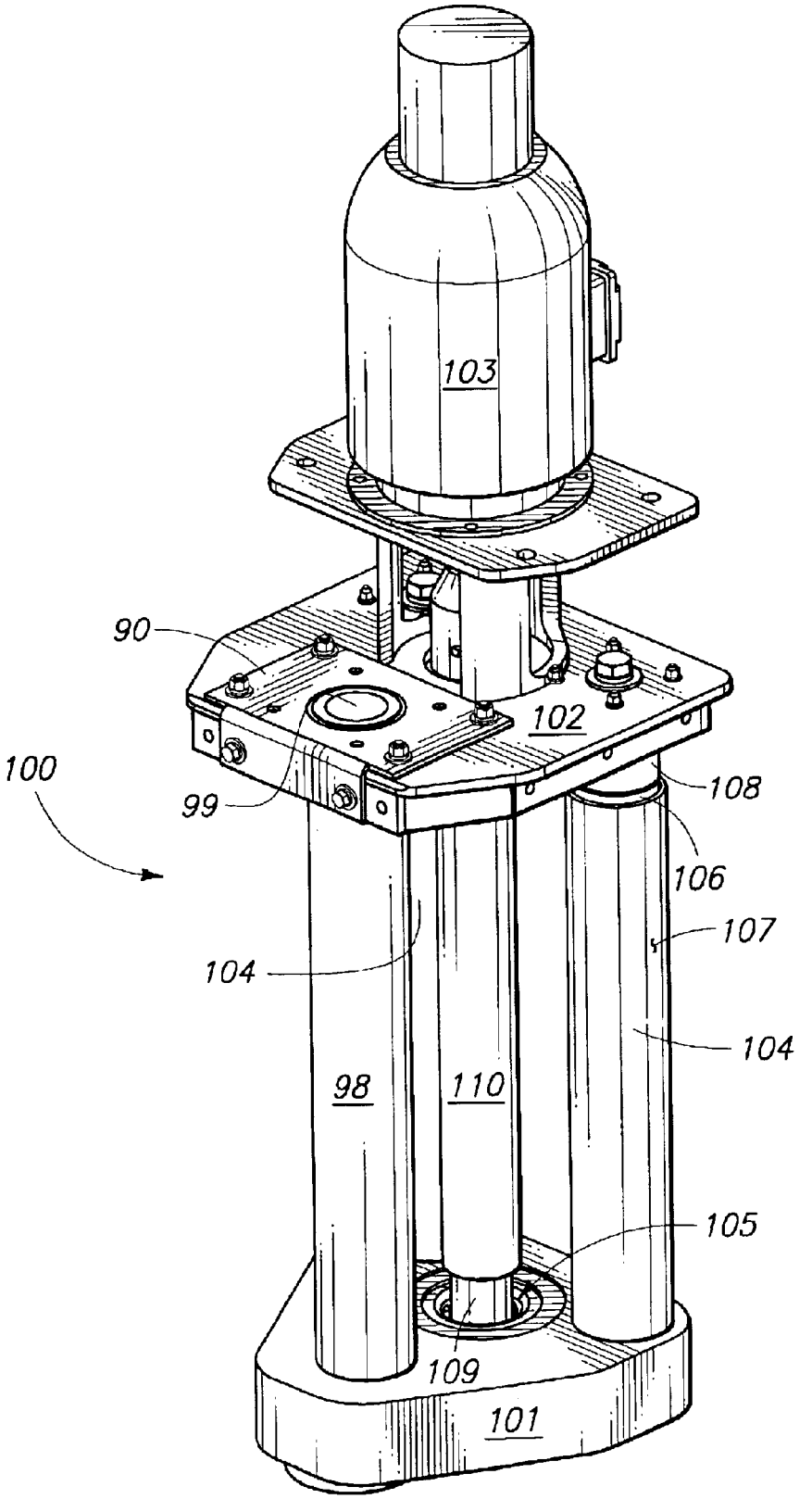
FIG. 1 is a perspective view of a molten metal pump system in which an embodiment of this invention may be used.

FIG. 1 is a perspective view of one embodiment of a molten metal pump system contemplated by this invention.

FIG. 1 illustrates pump motor 103, pump motor base, pump motor mount 102, pump base 101, pump riser post 98, second pump post 104, refractory impeller shaft 109, and shaft upper portion 110. FIG. 1 further illustrates a pump system 100 wherein pump post 104 exemplifies a standard pump post and refractory post 106. Pump post 104 is shown mounted to pump motor mount structure 102 via coupling 108. Pump riser post 98 includes an internal aperture 99 through which molten metal is pumped up from the pump base 101. Mount plate 90 secures and locates pump riser post 98 relative to pump motor mount structure 102. An embodiment of an impeller system contemplated by this invention would generally be located within pump base 101.

Figure 2:
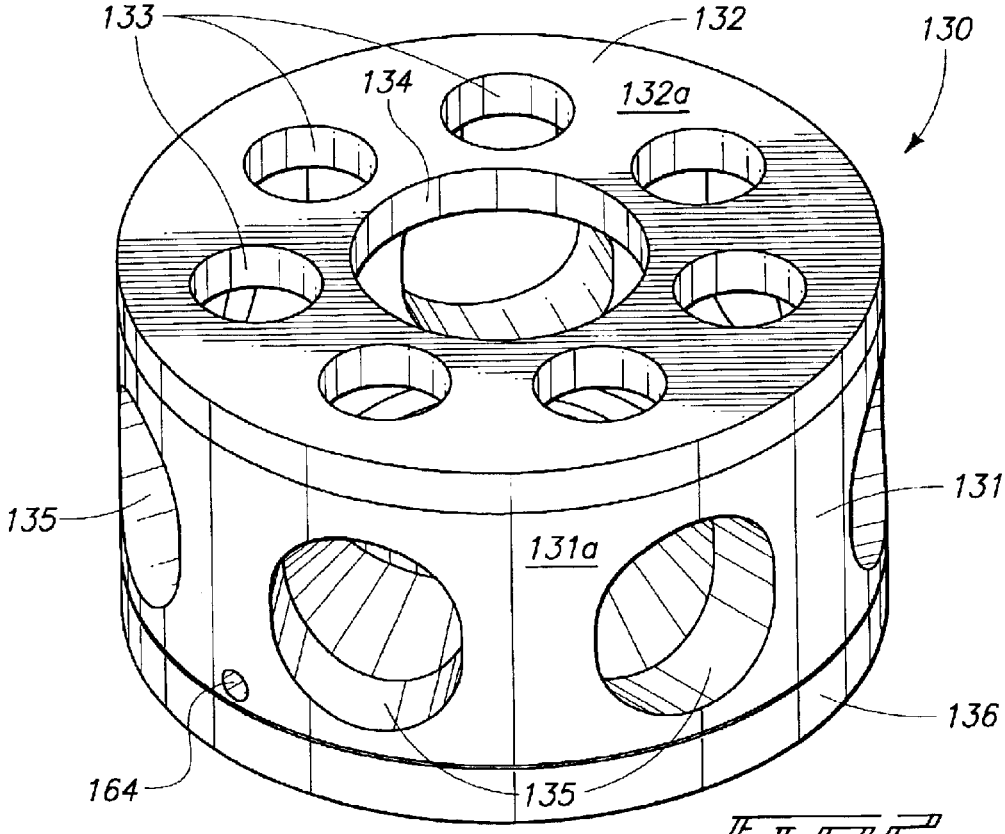
FIG. 2 is a perspective view of one embodiment of an impeller system contemplated by this invention.
Figure 10:
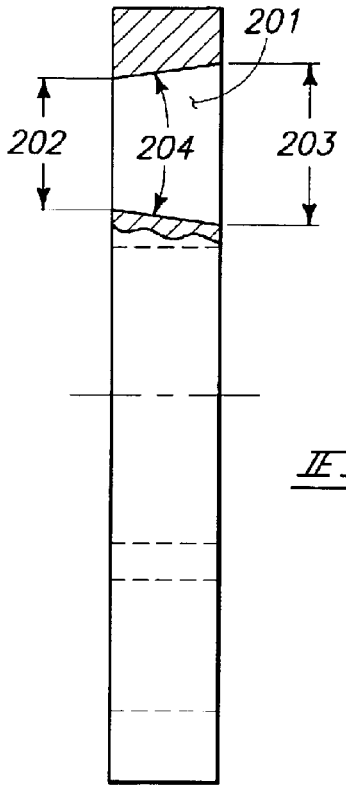
FIG. 10 is a side partial section view of another embodiment of an impeller lid which may be used in the embodiment of the invention, wherein the inlet apertures have a smaller cross-sectional area on the top surface relative to the bottom or inward surface.

FIG. 2 is a perspective view of one embodiment of an impeller system 130 contemplated by this invention, illustrating impeller lid 132 with top surface 132*a*, inlet apertures 133 through lid 132, impeller outer wall 131 with outer surface 131*a*, and outlet apertures 135 in outer wall 131, bottom 136 which may comprise part or all of the base. FIG. 2 also illustrates retention pin aperture 164 through outer wall 131. It should be noted that while certain numbers of inlets or inlet apertures 133 are shown through lid 132, no particular number of inlets 133 are required to practice this invention. Furthermore, the inlets 133 may be sized or configured in a number of different ways to suit the application, and in some cases, to suit the anti-clogging functions of the inlet size or configuration. For instance, FIG. 10 illustrates a tapering of the inlet apertures to reduce clogging.

Figure 11:
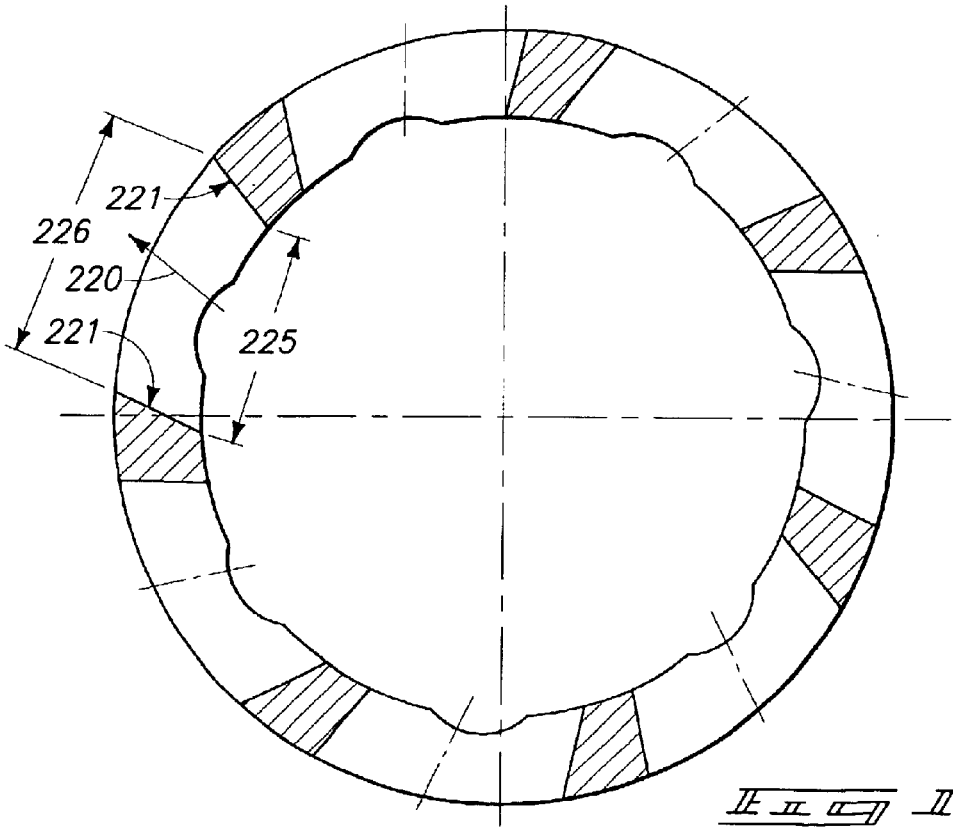
FIG. 11 is an alternative top section view 6—6 from FIG. 5 (like FIG. 6), of the outer wall of the impeller system, only wherein the outlet apertures have a smaller cross-sectional area on the inward side (inner surface) relative to the outward side (outward surface).

Similarly, while certain numbers of outlets or outlet apertures 135 are shown through outer wall 131, no particular number of outlets 135 are required to practice this invention. Furthermore, the outlets 135 may be sized or configured in a number of different ways to suit the application, and in some cases, to suit the anti-clogging functions of the inlet size or configuration. For instance, FIG. 11 illustrates a tapering of the inlet apertures to reduce clogging. In other embodiments, the size of the outlets or outlet apertures 135, is larger (and in some cases, significantly larger) than the inlet apertures 133.

Figure 3:
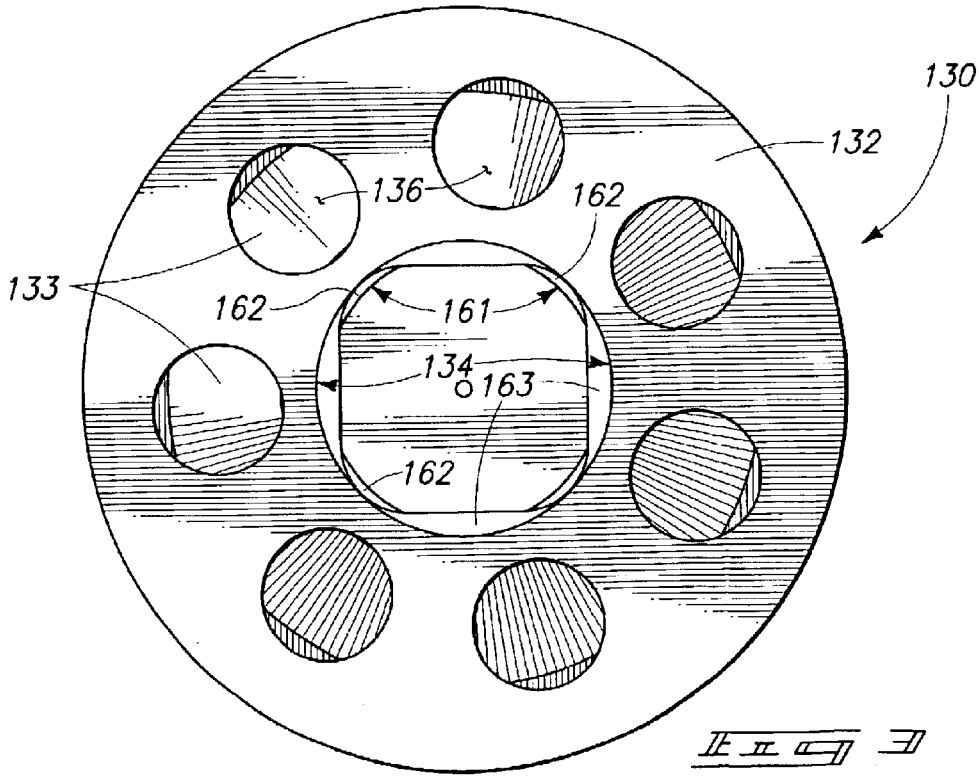
FIG. 3 is a top view of the impeller system illustrated in FIG. 2.

FIG. 3 is a top view of the embodiment of the impeller system 130 illustrated in FIG. 2, showing impeller lid 132, top side or top surface 136 of impeller base or bottom, inlet apertures 133 through impeller lid 132 and shaft aperture 134 through impeller lid 132.

Looking through shaft aperture 134 in the center of lid 132, shaft coupling components may be seen. The shaft coupling illustrated in this embodiment of the invention includes a coupling aperture with side walls 161, shoulders 163, and corner curvatures 162 in the shaft coupling aperture. This is one of a number of configurations which may be utilized, this one in particular being usable in combination with the impeller shaft illustrated in FIG. 9.

FIG. 4 is an exploded elevation view of the embodiment of the impeller system illustrated in FIG. 2, showing outer surface 131*a* of outer wall 131, outlet apertures 135, impeller lid 132 with top surface 132*a* and bottom surface 132*b*, impeller base or bottom ring 136 which is mounted around base mount 141. To mount impeller bottom ring 136 around base mount 141, cement grooves 142 are utilized to provide an aperture or groove in which to insert cement before attaching impeller bottom 136 to impeller outer wall 131. Bottom ring 136 may, but need not, be made of a material more suitable for rotation within the pump base, for wear or other purposed.

FIG. 4 also illustrates another portion of impeller base, the central portion 140, which includes grooves 139 therein for placing cement before central portion 140 is inserted within central portion aperture within the bottom of the impeller. It will be appreciated by those of ordinary skill in the art that the central portion 140 may, but need not be, a separate piece cemented into place, as it may also be one piece with the outer wall 131 and the remainder of the impeller bottom.

Figure 5:
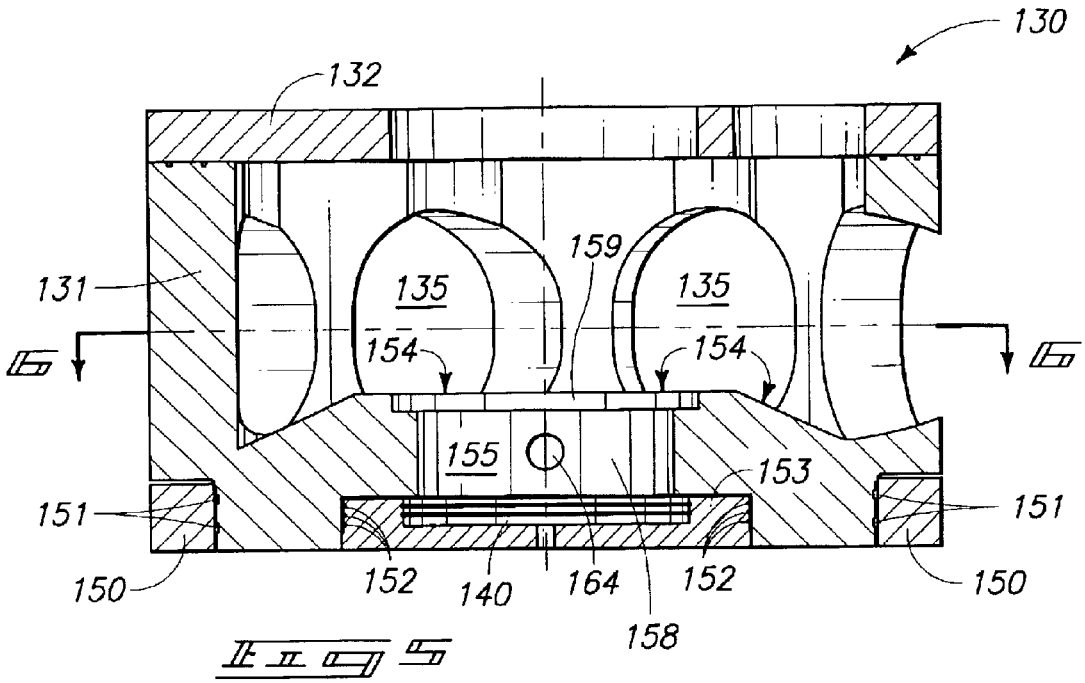
FIG. 5 is a partial section view of the embodiment of the impeller system shown in FIG. 4.

FIG. 5 is partial cross section of the impeller system 130 reflected in FIG. 4, and illustrates impeller lid 132, outlet apertures 135, outer wall 131 with bottom or base ring 150 mounted to the impeller body. Grooves 151 between outer ring 150 and impeller body are preferably present for the application or insertion of cement therein to assist in securing the outer ring 150 to the impeller body.

FIG. 5 further illustrates central portion 153 of impeller base with grooves 152 to allow cement to be inserted therein to secure center portion 153 to the impeller body. The top surface 154 of the bottom portion of the impeller is also shown, with shaft coupling aperture 155 being the aperture into which the shaft is inserted. The shoulder 163 from FIG. 3 is the shoulder or abutment against which a shaft would preferably be abutted to properly position or locate it within shaft aperture 161. The shaft (such as that shown in FIG. 9) is moved into the shaft aperture, which is also reflected as item 155 in FIG. 5, until a shoulder on the shaft abuts the shoulder 163 (shown in FIG. 3). At that point, the shoulder locates the shaft within shaft aperture 155 which preferably has the rounded corners 161 shown in FIG. 3. The shaft is typically then cemented into place after a shaft pin 184 (shown in FIG. 9) is inserted into the appropriate apertures. Shaft coupling 140 is shown mounted within the impeller system and shaft pin aperture 164 is shown through the impeller body.

The outer wall 131 combined with the top surface of the impeller bottom 154, and the impeller lid 132, define an open inner cavity into which molten metal enters through inlet apertures 135 in the impeller lid 132, and the molten metal then exits through outlet apertures 135 in outer wall 131 as the impeller system 130 is rotated.

It will also be noted by those of ordinary skill in the art that the impeller base does not include a column or hub, the absence of which is believed to further decrease the chances of clogging. In this embodiment of an impeller system contemplated by this invention, the impeller shaft is attached directly into the base, which is believed to allow a larger relative interior cavity and also a better balanced impeller during operation.

Figure 6:
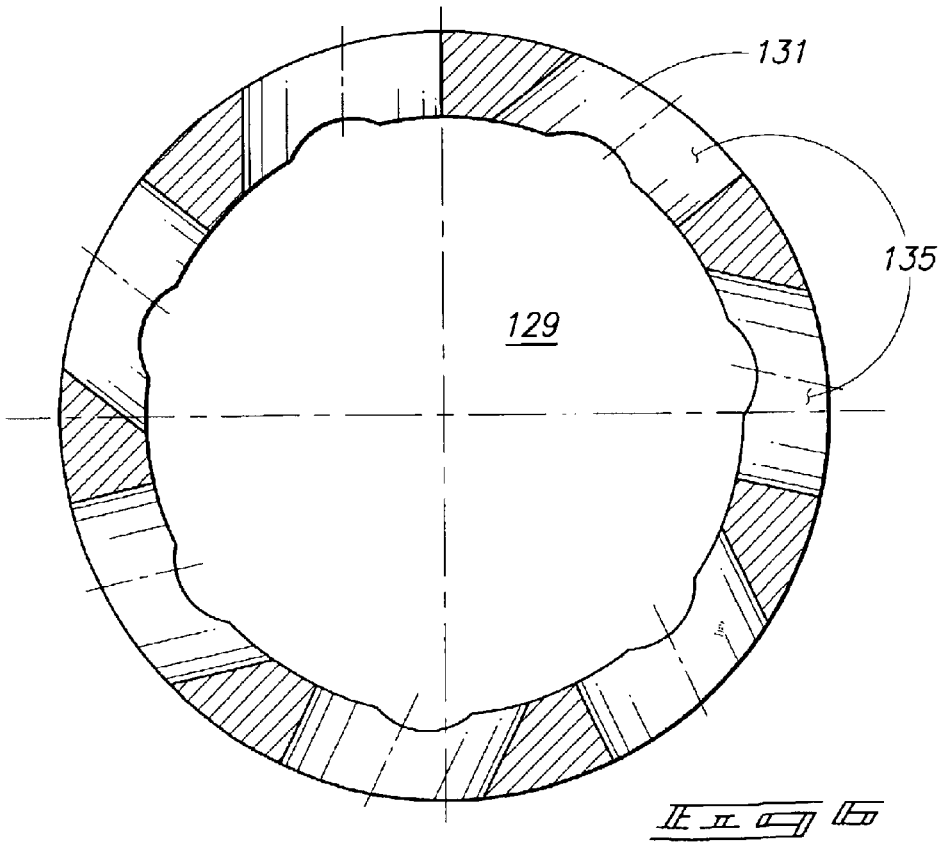
FIG. 6 is a top section view 6—6 from FIG. 5, of the outer wall of the impeller system illustrated in FIG. 2.

FIG. 6 is section 6—6 from FIG. 5 and illustrates a cross section of outer wall 131, with internal cavity 129 of the impeller system. Embodiments of outlet apertures 135 are also illustrated in FIG. 6.

Figure 7:
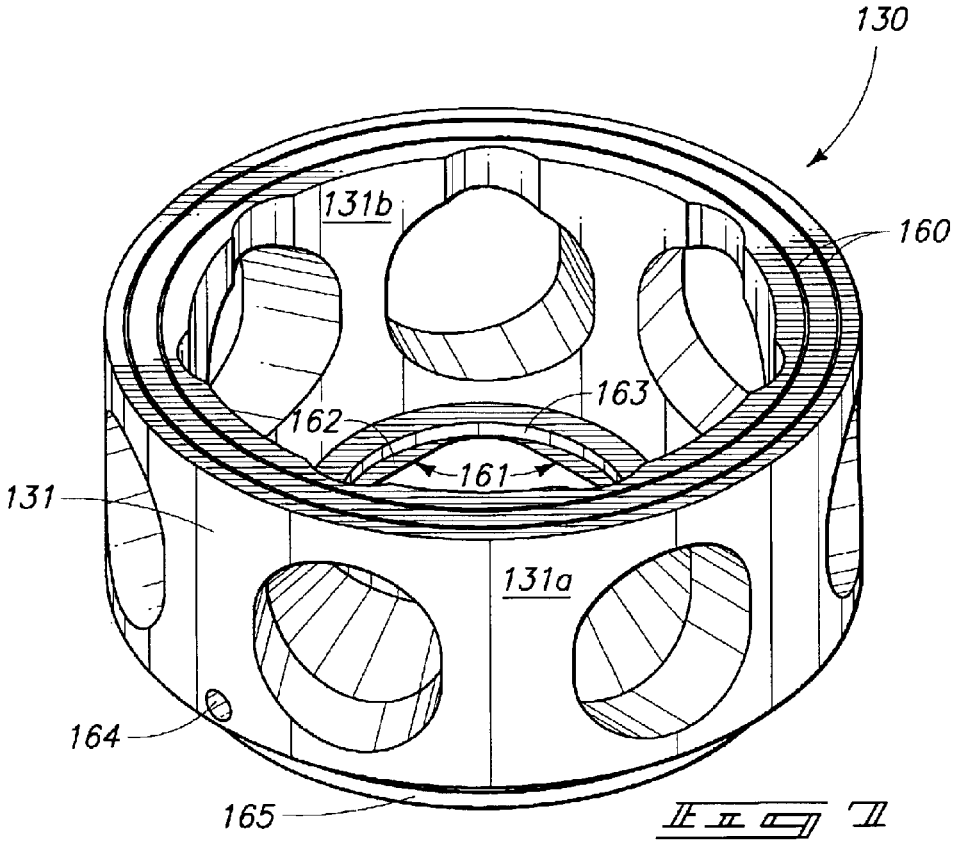
FIG. 7 is a perspective view of an embodiment of an impeller system contemplated by this invention, shown with the impeller lid removed.

FIG. 7 is a perspective view of the embodiment of the impeller system illustrated in figures above and shows outer wall 131, shaft pin aperture 164, inner surface 131*b* and outer surface 131*a* of outer wall 131, a bottom portion 165 of the impeller body, grooves 160 in a top surface of the outer wall for the placement of cement to better facilitate the attachment of impeller lid (not shown in FIG. 7) to the outer wall 131. FIG. 7 also illustrates the shaft coupling mechanism utilized in this invention, showing shaft aperture walls 161 (with a corner curvature, as shown in other figures), shoulder 162 and central portion 163.

Figure 8:
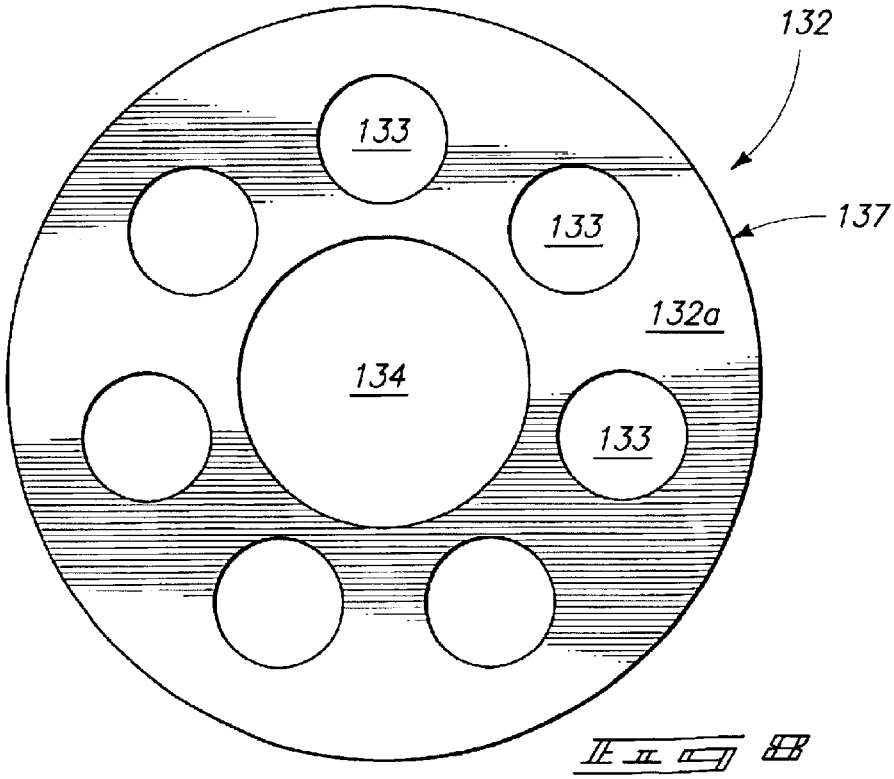
FIG. 8 is a top view of an impeller lid which may be used in the embodiment of the invention illustrated in FIG. 2.
Figure 9:
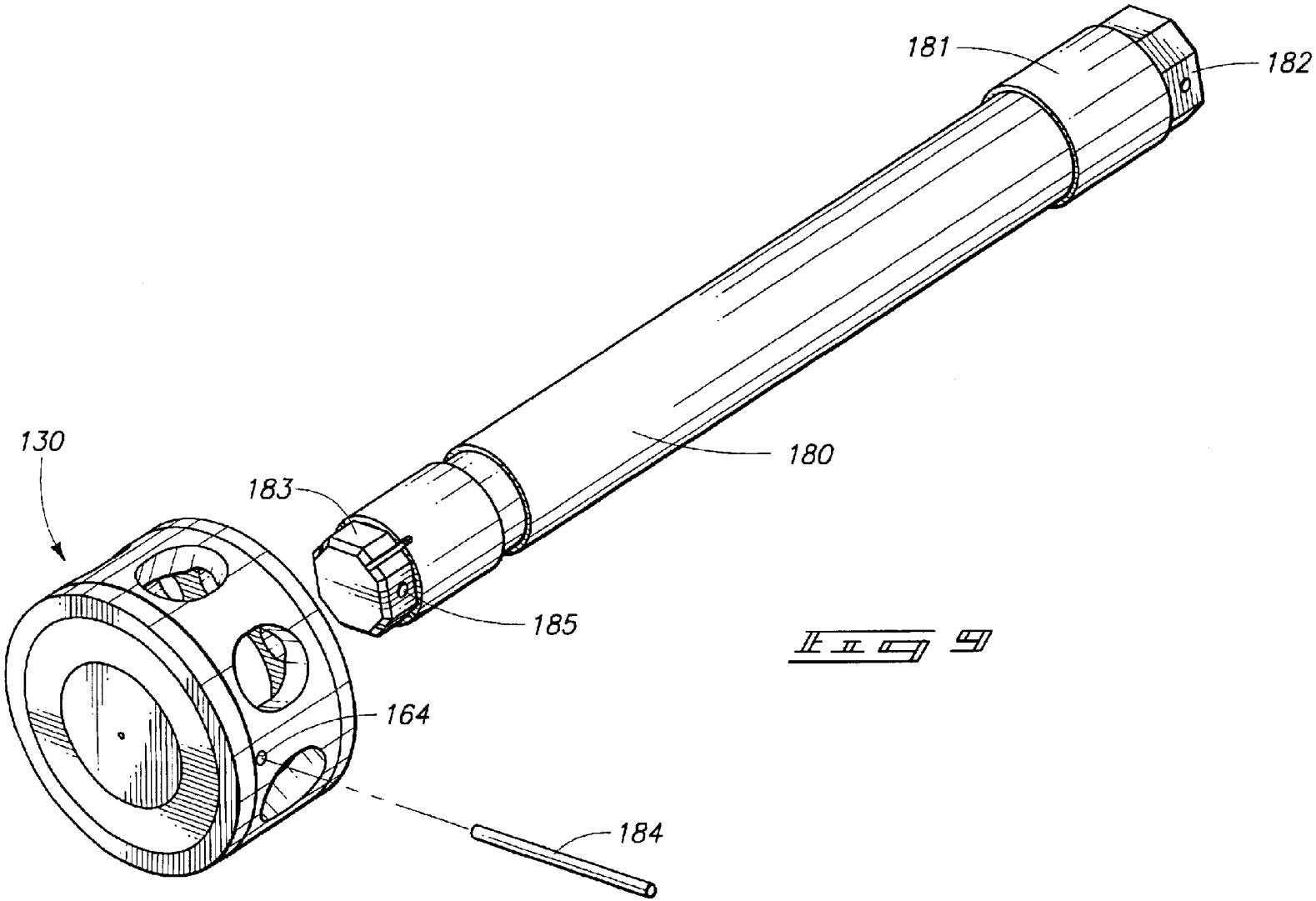

FIG. 8 is a top view of an embodiment of a containment lid 132 which may be used as part of the embodiment of the impeller system illustrated in figures above. FIG. 8 shows impeller lid 132 with outer surface 137, inlet apertures 133, shaft aperture 134 and top surface 132*a* of impeller lid 132.

It will be noted by those of ordinary skill in the art that there can be any one of a number of different combinations and sizes of inlet apertures 133 as well as the general geometry or configuration of impeller lid 132.

Figure 9:
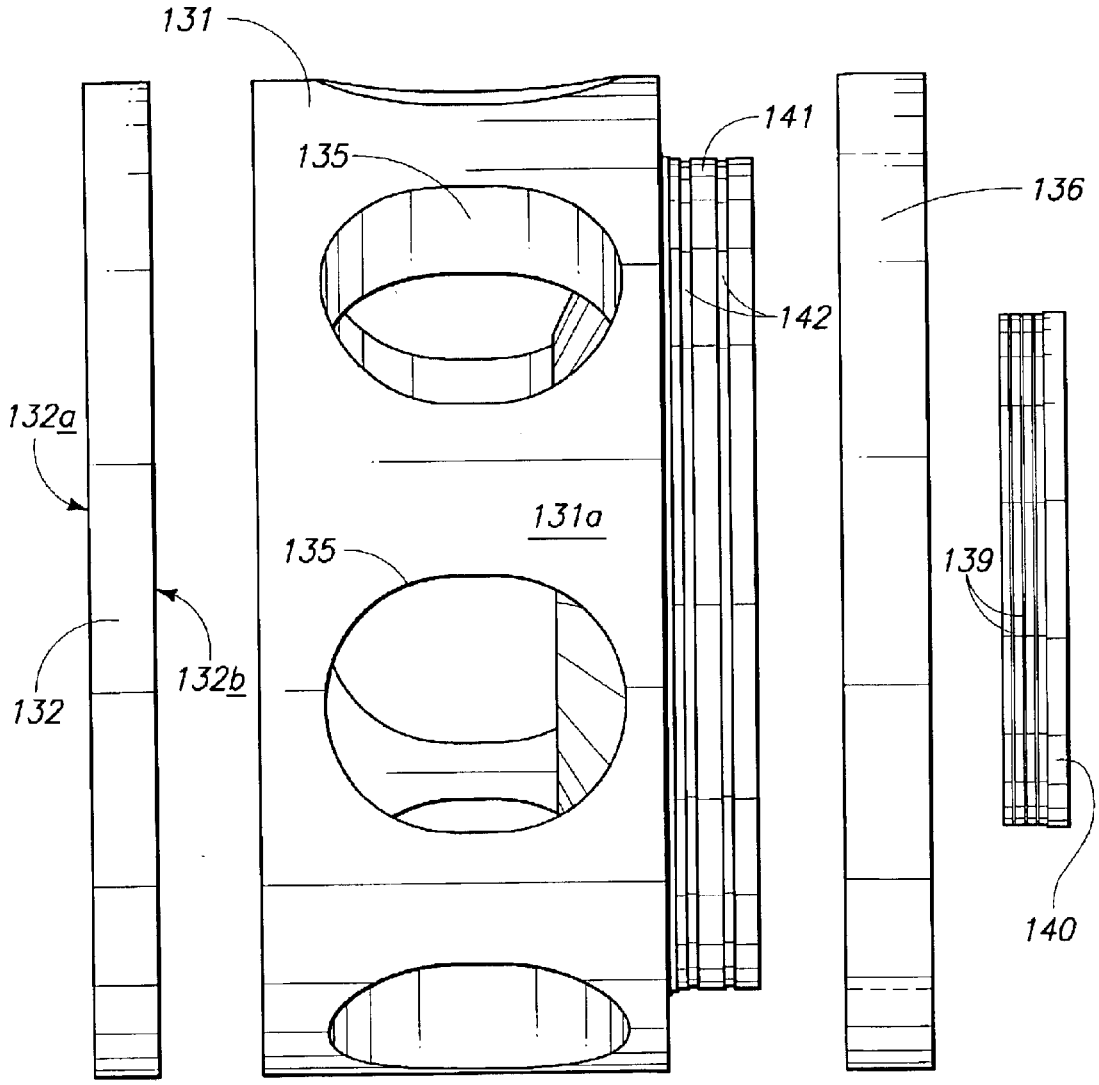
FIG. 9 is an exploded perspective view of the embodiment of the impeller system illustrated in FIG. 2, combined with a shaft assembly which may be utilized in combination therewith.

FIG. 9 is a perspective exploded view of the embodiment of the impeller system 130 shown in combination with an impeller shaft 180 which may be used in combination therewith. FIG. 9 illustrates impeller shaft 180 with drive coupling 181 and drive coupling connection end 182.

The impeller system 130 is shown with shaft pin aperture 164 and shaft pin 184. A shaft aperture 185 in the shaft corresponds to and is contiguous with shaft aperture 164 in the impeller outer wall, such that shaft pin 184 may be inserted through both to help secure it in place.

Impeller shaft 180 includes coupling end 183 for coupling and attaching the impeller shaft 180 to the impeller system 130. The coupling end 183 of impeller shaft 180 inserts into and interacts with the shaft coupling configuration shown and discussed in FIGS. 3 and 7.

Once the impeller shaft 180 is correctly inserted into the shaft coupling in the impeller system 130, shaft pin 184 may be inserted into and through shaft pin aperture 164 and shaft pin aperture 185 to thereby secure the impeller system 130 to the impeller shaft 180. The drive coupling 181 may then be attached in the same, similar or different way to the motor or other intermediate components between the impeller shaft 180 and a motor which would be utilized as part of a molten metal pump system.

FIG. 10 is a side view of another embodiment of an impeller lid which may be used in the embodiment of the invention, only wherein the inlet apertures 204 have a smaller cross-sectional area 202 on the outward side, which is the top surface when the lid is on the outer wall of the impeller system. Inlet aperture 204 with inlet size 202 at the top surface of the lid is smaller in diameter than the outlet size 203 (which opens into the interior cavity of the impeller. The tapering or enlargement of the bottom side of the inlet apertures 204 gives chunks of material in the molten metal a better chance or clearance to pass through the inlet aperture 204 without clogging. Once the metal chunks or undesirables are in the interior cavity, the outlets in the outer wall (not shown in FIG. 10), being sized larger than the inlets, more freely allow the particles or chunks to flow outward.

FIG. 11 is an alternative top section view 6—6 from FIG. 5 (like FIG. 6), of the outer wall of the impeller system, only wherein the outlet apertures 221 have a smaller cross-sectional area 225 on the inward side relative to the cross-sectional area 226 on or at the outward side or outer surface. Metal flows outward in the direction of arrow 220 when the impeller is rotated.

As will be appreciated by those of reasonable skill in the art, there are numerous embodiments to this invention, and variations of elements and components which may be used, all within the scope of this invention.

One embodiment of this invention, for example, is a molten metal pump impeller system comprising: an impeller which comprises: an radially outward outer wall with a top end, a bottom end, an outer side and an inner side, the outer wall including a plurality of outlet apertures from the inner side to the outer side; an impeller base at the bottom end of the outer wall, the impeller base including an impeller shaft aperture; an impeller lid at the top end of the outer wall and opposite the bottom end, the impeller lid including a top surface, a bottom surface, at least one inlet aperture from the top surface to the bottom surface, and a shaft aperture configured to receive an impeller shaft.

In other or further embodiments of the foregoing, the system may be: further wherein the impeller base and the outer wall are integral; further wherein the impeller base and the outer wall are one piece; further wherein the at least one inlet in the impeller lid is a further wherein the shaft aperture in the impeller base is the exclusive area for attachment of an impeller shaft; further wherein the inlet apertures in the impeller lid are sized such that a cross-sectional area near the top surface is greater than a cross-sectional area near the bottom surface; further wherein the outlet apertures in the outer wall are sized such that a cross-sectional area near the inner side is less than a cross-sectional area near the outer side; and/or further wherein the outlet apertures in the outer wall are sized such that a cross-sectional area near the inner side or inner surface is less than a cross-sectional area near the outer side or surface.

In another embodiment of the invention, an entire pump system embodiment, the molten metal pump system would be comprised of: a pump motor mounted on a pump motor mount; one or more pump posts attached at a first end to the pump motor mount and attached at a second end to a pump base; an impeller disposed within an impeller aperture within the pump base, the impeller comprising: an radially outward outer wall with a top end, a bottom end, an outer side and an inner side, the outer wall including a plurality of outlet apertures from the inner side to the outer side; an impeller base at the bottom end of the outer wall, the impeller base including an impeller shaft aperture; an impeller lid at the top end of the outer wall and opposite the bottom end, the impeller lid including a top surface, a bottom surface, at least one inlet aperture from the top surface to the bottom surface, and a shaft aperture configured to receive an impeller shaft; and an impeller shaft operatively connected at a first end to the pump motor and at a second end to the impeller.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A molten metal pump impeller system comprising:

an impeller which comprises:

an radially outward outer wall with a top end, a bottom end, an outer side and an inner side, the outer wall including a plurality of outlet apertures from the inner side to the outer side;

an impeller base at the bottom end of the outer wall, the impeller base including an impeller shaft aperture;

an impeller lid at the top end of the outer wall and opposite the bottom end, the impeller lid including a top surface, a bottom surface, at least one inlet aperture from the top surface to the bottom surface, and a shaft aperture configured to receive an impeller shaft, and further wherein the inlet apertures in the impeller lid are sized such that a cross-sectional area near the top surface is greater than a cross-sectional area near the bottom surface.

2. A molten metal pump impeller system as recited in claim 1, and further wherein the outlet apertures in the outer wall are sized such that a cross-sectional area near the inner side is less than a cross-sectional area near the outer side.

3. A molten metal pump impeller system comprising:

an impeller which comprises:

an radially outward outer wall with a top end, a bottom end, an outer side and an inner side, the outer wail including a plurality of outlet apertures from the inner side to the outer side;

an impeller base at the bottom end of the outer wall, the impeller base including an impeller shaft aperture;

an impeller lid at the top end of the outer wall and opposite the bottom end, the impeller lid including a top surface, a bottom surface, at least one inlet aperture from the top surface to the bottom surface, and a shaft aperture configured to receive an impeller shaft, and further wherein the outlet apertures in the outer wall are sized such that a cross-sectional area near the inner side is less than a cross-sectional area near the outer side.

* * * * *